US008196751B2

(12) United States Patent
Shuttleworth et al.

(10) Patent No.: US 8,196,751 B2
(45) Date of Patent: Jun. 12, 2012

(54) PERMANENT MAGNET DRUM SEPARATOR WITH MOVABLE MAGNETIC ELEMENTS

(75) Inventors: Timothy G. Shuttleworth, Girard, PA (US); Michael Ross, Waterford, PA (US); Christopher D. Cedzo, Fairview, PA (US); Rod Palombo, Erie, PA (US); Gregory Nowak, Fairview, PA (US)

(73) Assignee: Eriez Manufacturing Co., Erie, PA (US)

( * ) Notice: Subject to any disclaimer, the term of this patent is extended or adjusted under 35 U.S.C. 154(b) by 0 days.

(21) Appl. No.: 12/984,851

(22) Filed: Jan. 5, 2011

(65) Prior Publication Data

US 2011/0163015 A1 Jul. 7, 2011

(51) Int. Cl.
*B03C 1/00* (2006.01)

(52) U.S. Cl. ..... 209/215; 209/214; 209/217; 209/225; 209/228

(58) Field of Classification Search ..... 209/214, 209/215, 217, 225, 228
See application file for complete search history.

(56) References Cited

U.S. PATENT DOCUMENTS

| | | | | |
|---|---|---|---|---|
| 2,675,918 | A * | 4/1954 | Newton | 209/232 |
| 2,992,737 | A * | 7/1961 | Buus | 209/223.1 |
| 3,438,495 | A * | 4/1969 | Turnock | 209/219 |
| 3,452,310 | A | 6/1969 | Israelson | 335/286 |
| 3,947,349 | A | 3/1976 | Fritz | 209/214 |
| 4,052,883 | A | 10/1977 | Turnas | 73/12 |
| 4,314,219 | A | 2/1982 | Haraguchi | 335/295 |
| 4,813,729 | A | 3/1989 | Speckhart | 294/65.5 |
| 5,166,654 | A | 11/1992 | Doylle | 335/288 |
| 5,636,748 | A | 6/1997 | Arvidson | 209/223.2 |
| 6,471,273 | B1 | 10/2002 | Friedrich et al. | 294/65.5 |
| 7,841,474 | B2 * | 11/2010 | Grey et al. | 209/219 |
| 2005/0103688 | A1 | 5/2005 | McHenry | 209/223.2 |
| 2010/0228056 | A1 | 9/2010 | Wang et al. | 564/420 |

FOREIGN PATENT DOCUMENTS

| | | |
|---|---|---|
| GB | 1140794 | 1/1969 |

* cited by examiner

*Primary Examiner* — Terrell Matthews
(74) *Attorney, Agent, or Firm* — Jonathan M. D'Silva; MacDonald, Illig, Jones & Britton LLP

(57) ABSTRACT

What is presented is a permanent magnet drum separator for removal of a ferrous fraction from a material stream comprising a pickup magnet that is a rare earth permanent magnet that can be moved within the drum separator. The drum separator comprises a rotatable outer shell having tubular shape with a circular cross section. The drum separator includes a carry magnet that is positioned at a fixed location within the rotatable outer shell near the inside circumference of the rotatable outer shell. The pickup magnet is positioned on a hinge plate within the rotatable outer shell. The hinge plate has a first end attached to a hinge and a second end attached to a movable element. The hinge is positioned at a fixed location within the rotatable outer shell near the inside circumference of said rotatable outer shell. The movable element is able to move the pickup magnet about the hinge to vary the distance between the pickup magnet and the inside circumference of the rotatable outer shell.

7 Claims, 8 Drawing Sheets

28
12
28
20
28
20
28
20

PERMANENT MAGNET DRUM SEPARATOR WITH MOVABLE MAGNETIC ELEMENTS

BACKGROUND

There are several basic magnetic circuits that are used in magnetic drum separators that include permanent magnets, electromagnets, or a combination of the two types. Each type of magnetic circuit has its own drawbacks and advantages. Electromagnetic elements warm up during operation which reduces their effectiveness over time and further limit the distance over which they can operate.

There are also inefficiencies associated with the coil wrapped around a steel core in electromagnets that cannot be avoided which creates areas of lower strength magnetic fields near each end of the rotating drum assembly. In contrast, permanent magnets can be manufactured that take up the entire width of the drum shell giving a more even magnetic field across the entire width of the drum assembly.

When electromagnets heat up, they lose typically 30 percent of their ampere turns (ampere turns generate magnetic field). This corresponds to nearly 30 percent of the magnetic field they generate. Permanent magnets are less affected by heat increases than electromagnets. Permanent magnets also do not have the power requirements that electromagnets need to generate magnetic fields.

One of the biggest drawbacks with permanent magnets is there is no way to turn them off which makes maintenance, repair, and even routine cleaning difficult if any magnetic metal equipment is used. Therefore permanent magnets with lower strength than are ideal have been used in the past. What is proposed is a system in which stronger permanent magnets can be used in a drum separator such that the permanent magnet elements can be moved away from the surface of the rotating drum element to reduce the strength of the magnetic field as needed for maintenance, repair, and routine cleaning. In addition to making permanent magnet drum separators easier to maintain, making the rare earth permanent magnet pickup magnets moveable within the drum separator also allows the operator to "fine-tune" the strength of the magnetic field to vary the grade of the product stream in the ferrous and the non-ferrous fraction as required for the particular application.

SUMMARY

What is presented is a permanent magnet drum separator for removal of a ferrous fraction from a material stream comprising a pickup magnet that is a rare earth permanent magnet that can be moved within the drum separator. The drum separator comprises a rotatable outer shell having tubular shape with a circular cross section. The drum separator includes a carry magnet that is positioned at a fixed location within the rotatable outer shell near the inside circumference of the rotatable outer shell. The pickup magnet is positioned on a hinge plate within the rotatable outer shell. The hinge plate has a first end attached to a hinge and a second end attached to a movable element. The hinge is positioned at a fixed location within the rotatable outer shell near the inside circumference of said rotatable outer shell. The movable element enables the pickup magnet to move about the hinge to vary the distance between the pickup magnet and the inside circumference of the rotatable outer shell.

The pickup magnet can be built with rare earth magnets having energy products between 35 MGOe and 42 MGOe. More than one array of pickup magnets could be arranged in series on the hinge plate. The movable element may be hydraulically or electrically actuated cylinders.

Those skilled in the art will realize that this invention is capable of embodiments that are different from those shown and that details of the devices and methods can be changed in various manners without departing from the scope of this invention. Accordingly, the drawings and descriptions are to be regarded as including such equivalent embodiments as do not depart from the spirit and scope of this invention.

BRIEF DESCRIPTION OF DRAWINGS

For a more complete understanding and appreciation of this invention, and its many advantages, reference will be made to the following detailed description taken in conjunction with the accompanying drawings.

DETAILED DESCRIPTION

Figure 1:
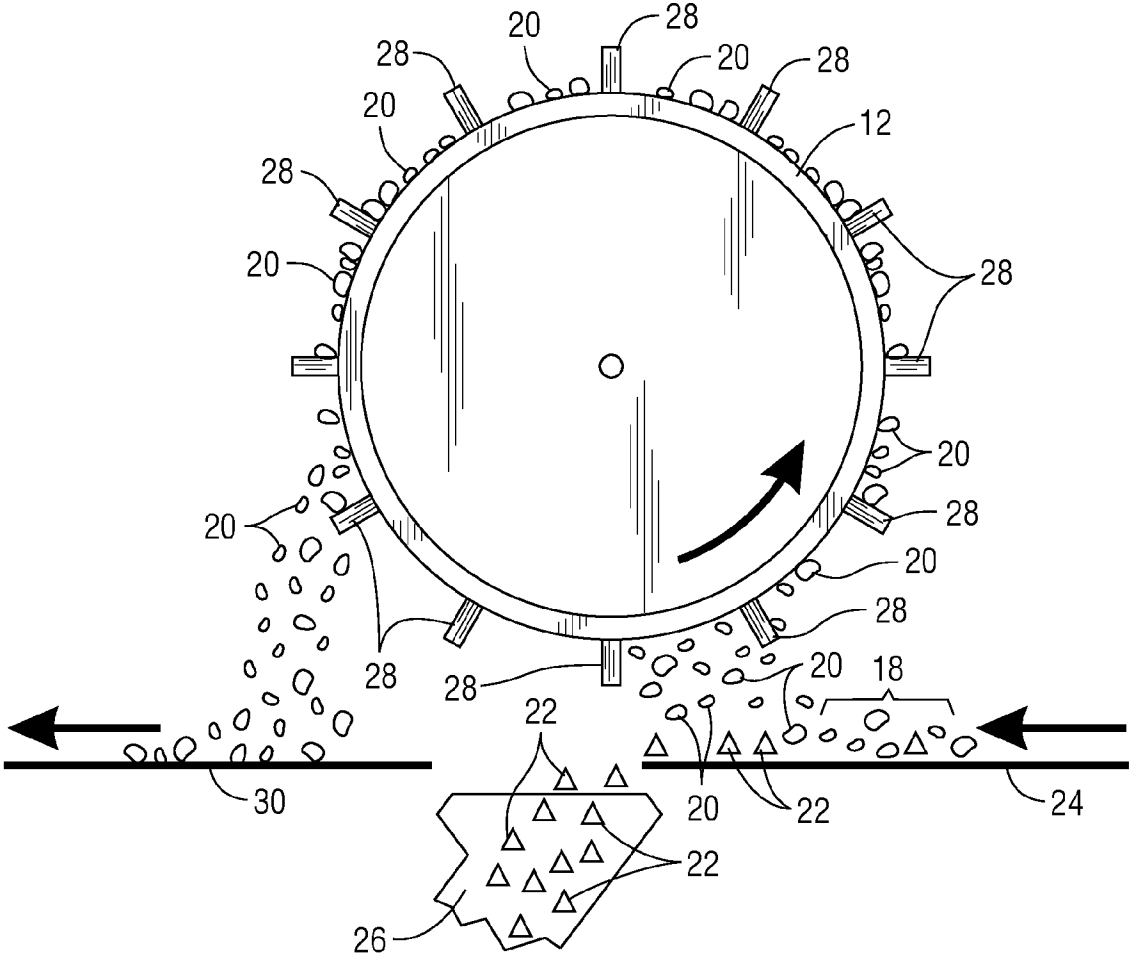
FIG. 1 depicts a close-up depicting a drum separator in operation.

Referring to the drawings, some of the reference numerals are used to designate the same or corresponding parts through several of the embodiments and figures shown and described. Corresponding parts are denoted in different embodiments with the addition of lowercase letters. Variations of corresponding parts in form or function that are depicted in the figures are described. It will be understood that variations in the embodiments can generally be interchanged without deviating from the invention.

Figure 2:
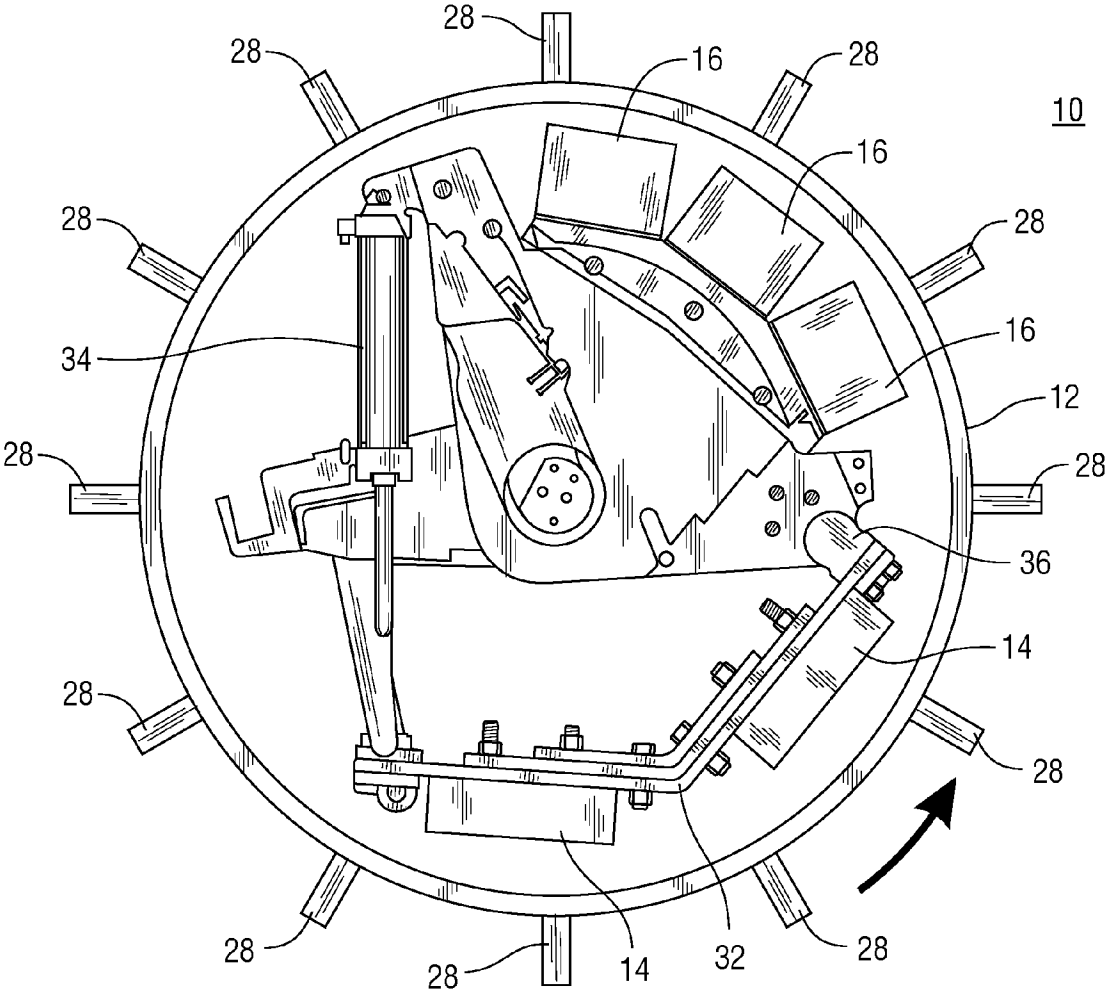
FIG. 2 is a cut-out view of the outer shell of the drum separator of FIG. 1 showing the cylinders in the fully extended position.

Drum separators are used to remove the ferrous fraction from a material stream in recycling, municipal solid waste, wood waste, slag, incinerator bottom ash, foundry sand, and in mineral processing applications. As shown in FIG. 1, the drum separator 10 according to one embodiment of this invention consists of an outer shell 12 that is rotated by a drive mechanism (not shown) in the direction indicated in the figure around a number of magnetic elements that are housed within the outer shell 12. As shown in FIG. 2, the magnetic elements include at least one pickup magnet 14 and at least one carry magnet 16.

As can be best understood by comparing FIGS. 1 and 2, the material stream 18 to be sorted comprises a mixture of ferrous 20 and non-ferrous 22 materials. The material stream 18 is passed under the drum separator 10 using any appropriate first transfer system 24 such as conveyors, chutes, vibrators, etc. while the outer shell 12 is rotated. The ferrous 20 fraction is magnetically attracted to the pickup magnet 14 relatively under the drum separator 10 and becomes magnetically attached to the surface of the outer shell 12. The non-ferrous 22 fraction of the material stream 18 that is not attracted to the outer shell 12 falls off the first transfer system 24 into a chute 26 or other means for disposal or further processing.

The outer shell 12 has a series of cleats 28 that assist the movement of the ferrous 20 material along the rotation axis of the drum separator 10. As the outer shell 12 rotates, the ferrous 20 material passes from the magnetic field generated by the pickup magnet 14 to the magnetic fields of the carry magnet 16. A bucking or interpole magnet (not shown) can be interposed between the pickup magnet 14 and the carry magnet 16 to reduce, if not eliminate, instances in which material falls away from the outer shell 12 during the transfer from the pickup magnet 14 to the carry magnet 16. The rotating outer shell 12 carries the ferrous 20 fraction around past the carry magnets 16 to discharge onto any appropriate second transfer system 30 such as conveyors, chutes, vibrators, etc. as demanded by the specific application for disposal or further processing.

The pickup magnet 14 and the carry magnet 16 are permanent magnets and may be single magnets or stacks of magnets arranged to form a desired configuration. The pickup magnets 14 are rare earth magnets and the carry magnet 16 may be ceramic or ferrite magnets. Ceramic and ferrite magnets have energy products of about 3.5 MGOe (mega gauss oersteds). The rare earth magnets used for the pickup magnets 14 have are at least 35 MGOe to about 42 MGOe. The pickup magnets 14 and carry magnets 16 are sized and arrayed to stretch across the width of the outer shell 12. The embodiments shown in the figures show drum separators 10 in which there are two arrays of pickup magnets 14 and three arrays of carry magnets 16, but it will be understood that the number of arrays of pickup magnets 14 and carry magnets 16 can vary depending on the application. One array of pickup magnets 14 would be able to provide separation. More than two arrays of pickup magnets 14 could also be used if constructed to fit within the allowable space within the outer shell 12. The number of arrays of carry magnets 16 can similarly be varied depending on the application.

In the prior art, the pickup magnets 14 tended to be electromagnets. Electromagnets are created by wrapping a conductive coil around a rectangular steel core and passing an electrical charge through the coil which generates a corresponding magnetic field. The strength of the magnetic field varies with the amount of current passed through the coil. Electromagnets suffer from a number of drawbacks. Firstly, passing an electric current through the coil generates heat in the coil. The heat builds up over time and increases the electrical resistance in the coil which reduces the ampere turns of the coil (the amount of current that can pass through the coil) and decreases the strength of the magnetic field. Over the course of a day's use, the drop off in ampere turns in the coil could be in the range 60-70% of what it was when the electromagnet is first turned on cold. The drop in field strength roughly parallels the drop in ampere turns. Force index is a value that can be both measured and used to predict the resulting separation. Force index is the magnetic field strength, gauss, (B), times the gradient, (dB/dx), at that point in units of $B^2$/inch. A linear change in ampere turns in the coil results in a non-linear change in force. At a 70 percent value of original field strength the value of the force index is about 49 percent of the original force index.

Secondly, because electromagnetic coils must occupy a certain amount of space, the rectangular core of electromagnets cannot be as wide as the outer shell 12. Various techniques are used to widen the magnetic effect of a narrow core in electromagnetic drum separators, but the issue persists in that ferrous objects are missed at the outer edges of the drum.

Thirdly, transfer of ferrous objects from electromagnetic pickup magnets 14 and the permanent magnet carry magnets 16 can be difficult. The magnetic geometry is such that an area of low force is seen at the transfer point between the electromagnetic pickup magnets 14 and the permanent magnet carry magnets 16. Objects are frequently dropped. While these may be picked up again by the electromagnet, this contributes to a higher average loading on the outer shell 12 as the dropped materials are picked up again. This adds to the wear on outer shell 12 shortening its life and increasing maintenance costs.

To address these concerns, pickup magnets 14 comprising rare earth magnets have been developed. Because rare earth magnets are permanent magnets, they always generate a more or less constant magnetic field that does not vary significantly over the course of a work day. Rare earth permanent magnets can be sized to make the most use of the width of the outer shell 12. Drum separators 10 in which both the pickup magnets 14 and the carry magnets 16 are permanent magnets have a smoother transfer of ferrous materials between the rare earth pickup magnet 14 and the lower strength ceramic or ferrite carry magnets 16.

Rare earth permanent magnets were not used for pickup magnets 14 because the size of the magnets required and the strength of rare earth magnets makes them expensive and very strong. The strength of rare earth magnets make rare earth pick up magnets 14 quite dangerous to construct around and handle. Furthermore, as rare earth magnets cannot be turned off, there was no practical way to easily remove material attached to the drum separator 10 in case the rotating outer shell 12 was jammed. Required maintenance can also be difficult if metal equipment is required to make repairs. In order to reduce the magnetic field strength of the rare earth magnets near the surface of the outer shell 12, the pickup magnets 14 are mounted to a hinge plate 32. One end of the hinge plate 32 is connected to hydraulically or electrically actuated cylinders 34, as shown in FIGS. 2-7. The other end of the hinge plate 32 is mounted to a hinge 36. The hinge plate 32 is rotatable about the hinge 36.

Figure 3:
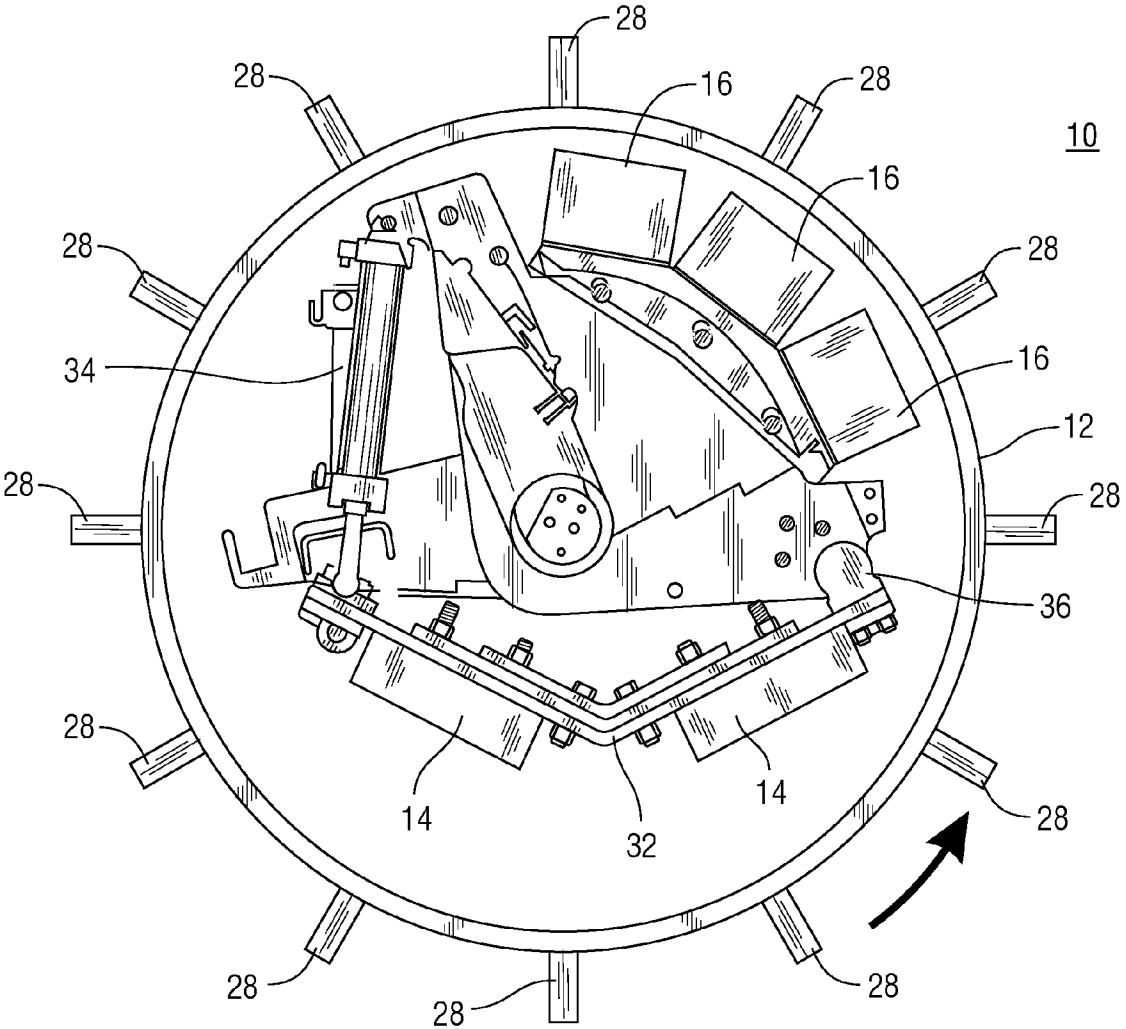
FIG. 3 shows the drum separator of FIG. 1 with the cylinders in the fully retracted position.
Figure 4:
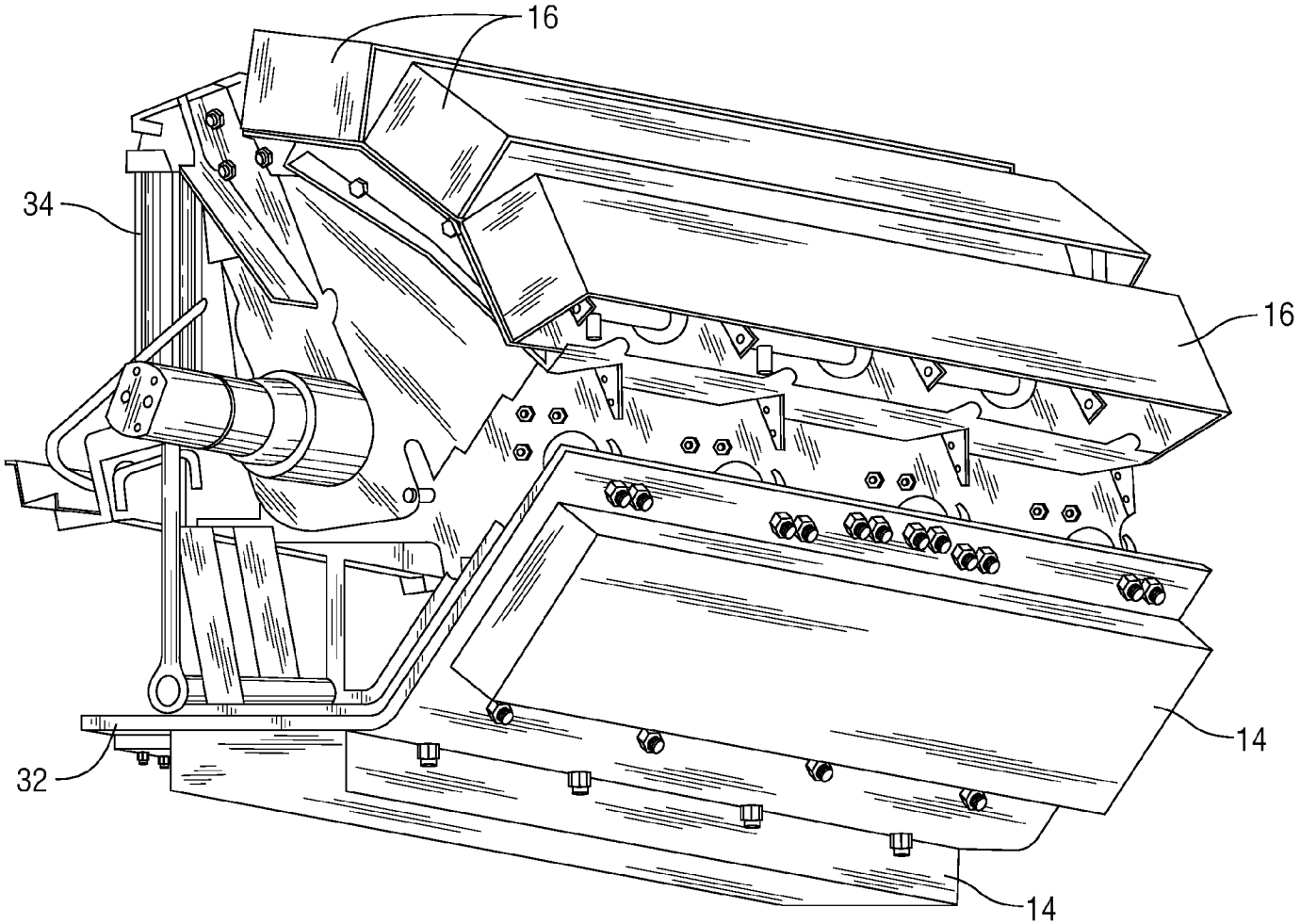
FIG. 4 is a perspective view of the inner mechanisms of the drum separator of FIG. 1 showing the cylinders in the fully extended position.
Figure 5:
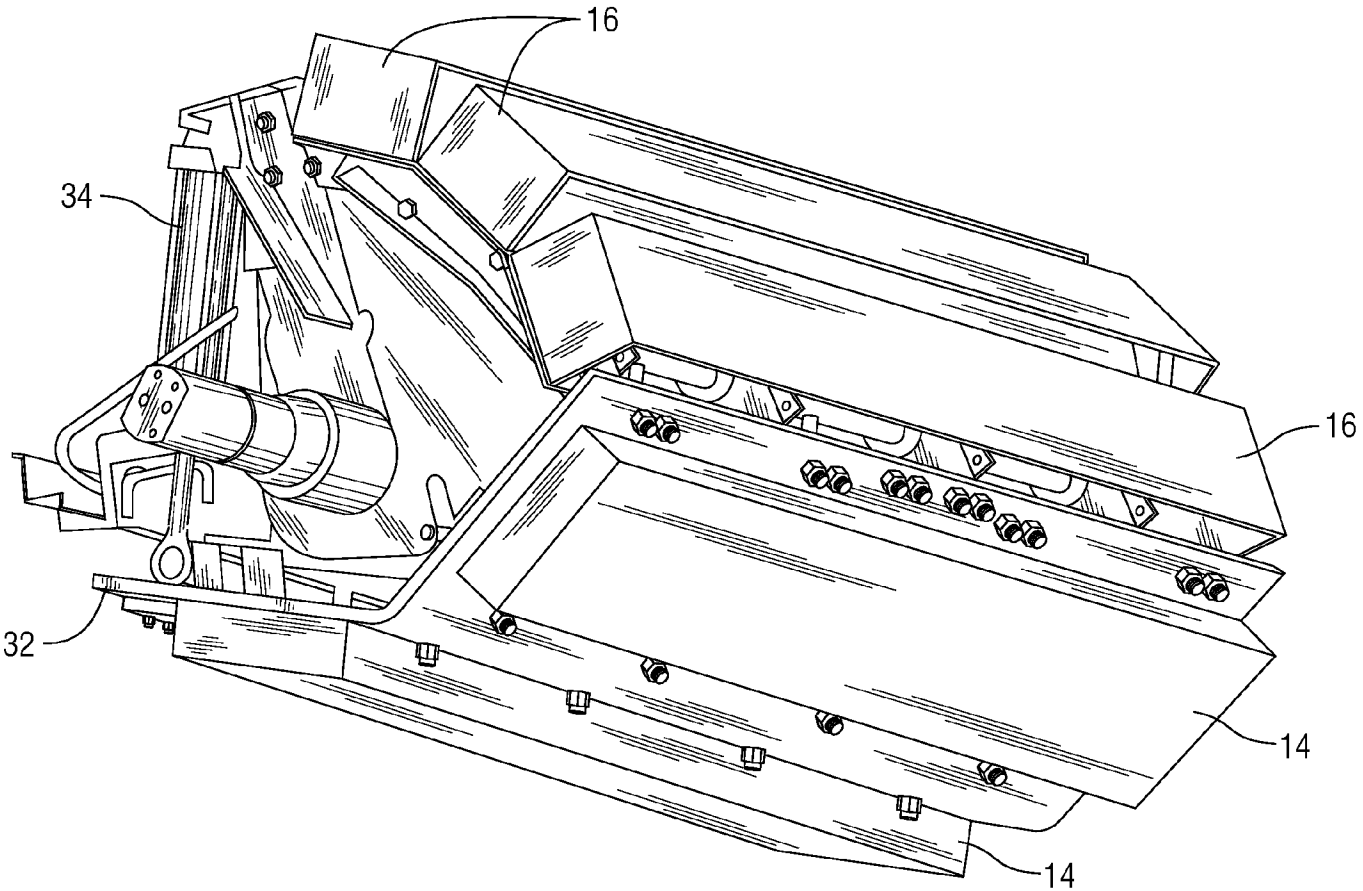
FIG. 5 is a perspective view of the inner mechanisms of the drum separator of FIG. 1 showing the cylinders in the fully retracted position.
Figure 6:
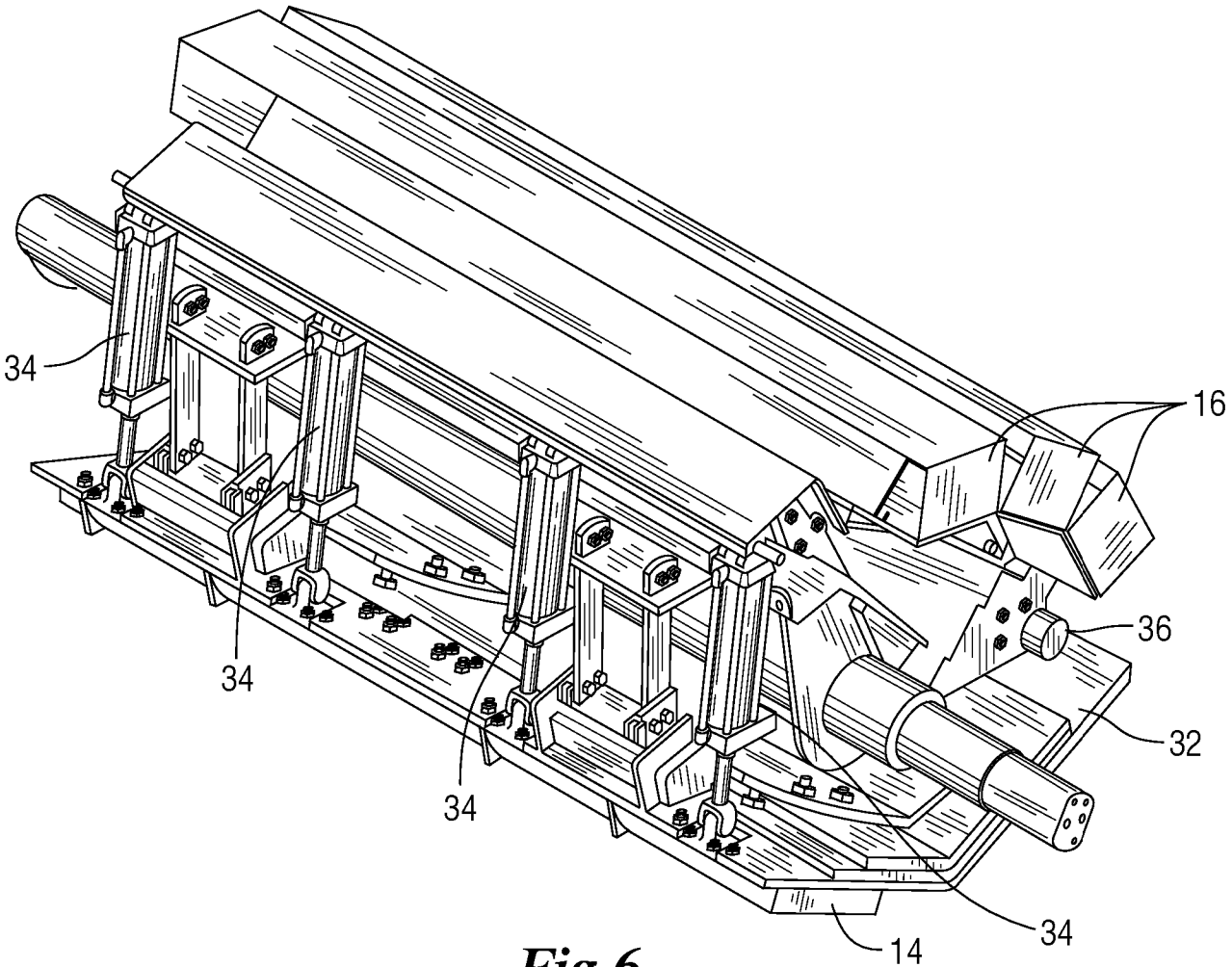
FIG. 6 is a different perspective view of the inner mechanisms of the drum separator of FIG. 1 showing the cylinders in the fully extended position.
Figure 7:
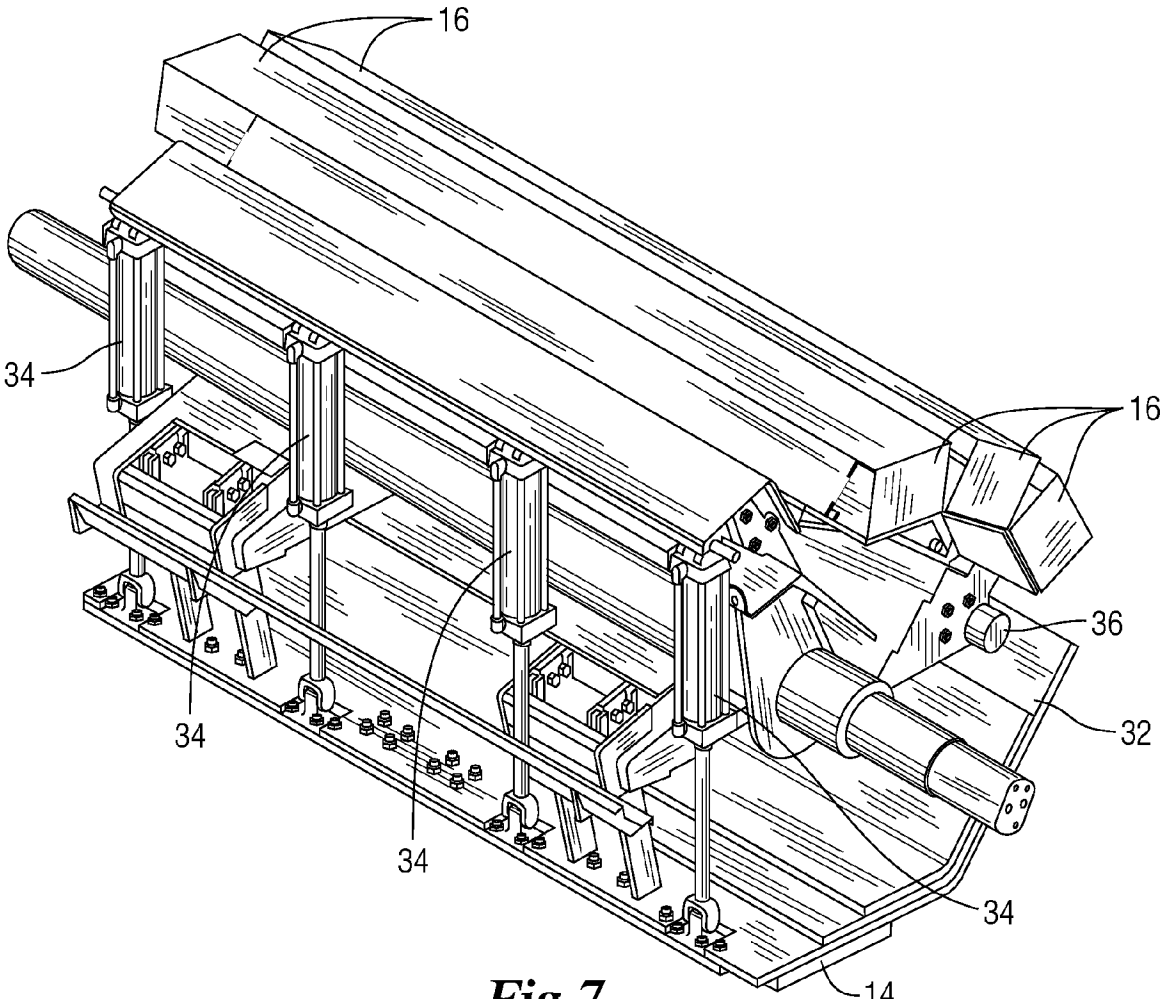
FIG. 7 is a perspective view of the inner mechanisms of the drum separator of FIG. 1 showing the cylinders in the fully retracted position.

When the drum separator 10 is in operation, the cylinders 34 are fully extended to position the pickup magnets 14 close to outer shell 12. This position maximizes the strength of the magnetic field at the outer surface of the outer shell 12. When the cylinders 34 are fully retracted, as shown in FIGS. 3, 5, and 6, the hinge plate 32 is pulled towards the center of the drum separator 10 which pulls the pickup magnets 14 away from the outer shell 12. This reduces the strength of the magnetic field at the outer surface of the outer shell 12. Generally with the pickup magnets 14 in the retracted position the strength of the magnetic field in the area influenced by the pickup magnet 14 would be reduced to be around that of ceramic or ferrite magnets. While this still a fairly strong magnetic field, it is an order of magnitude less than when the pickup magnets 14 are positioned closer to the inner circumference of the outer shell 12. The position of the cylinders 34 could be set to vary the strength of magnetic field at the outer surface of the outer shell 12 if particular applications require magnetic fields of greater or lesser strength.

Mounting the pickup magnets 14 to a movable hinge plate 32 not only allows for easier maintenance activities on the drum separator 10, but also provides the operator with the option of fine tuning the separation of the material stream 18. When the pickup magnets 14 are fully extended, the magnetic field extending from the outer shell 12 is at its strongest and the drum separator 10 will capture more of the ferrous fraction 20 from the material stream 18. In addition, stronger magnetic fields are more likely to pick up that fraction of the material stream 18 that is a conglomeration of ferrous and non-ferrous materials that may be missed with lower strength magnetic fields. If the drum separator 10 is in operation with the pickup magnets 14 fully retracted, the magnetic field extending from the outer shell 12 would be at its weakest and therefore more of the ferrous fraction 20 would likely pass with the non-ferrous fraction 22. By adjusting the position of the pickup magnets 14, the operator can "fine tune" the strength of the magnetic field to vary the grade of the product stream in the ferrous and the non-ferrous fraction as required for the particular application.

FIGS. 4-7 show various views of the internal workings of the drum separator at different angles in which the pickup magnets 14 are variously in the fully extended and the fully retracted positions. Other movable elements could be used to position the hinge plate 32 in the drum separator 10 instead of the cylinders 34 shown in the figures. Pulleys, chains, etc. would work just as well.

Figure 8:
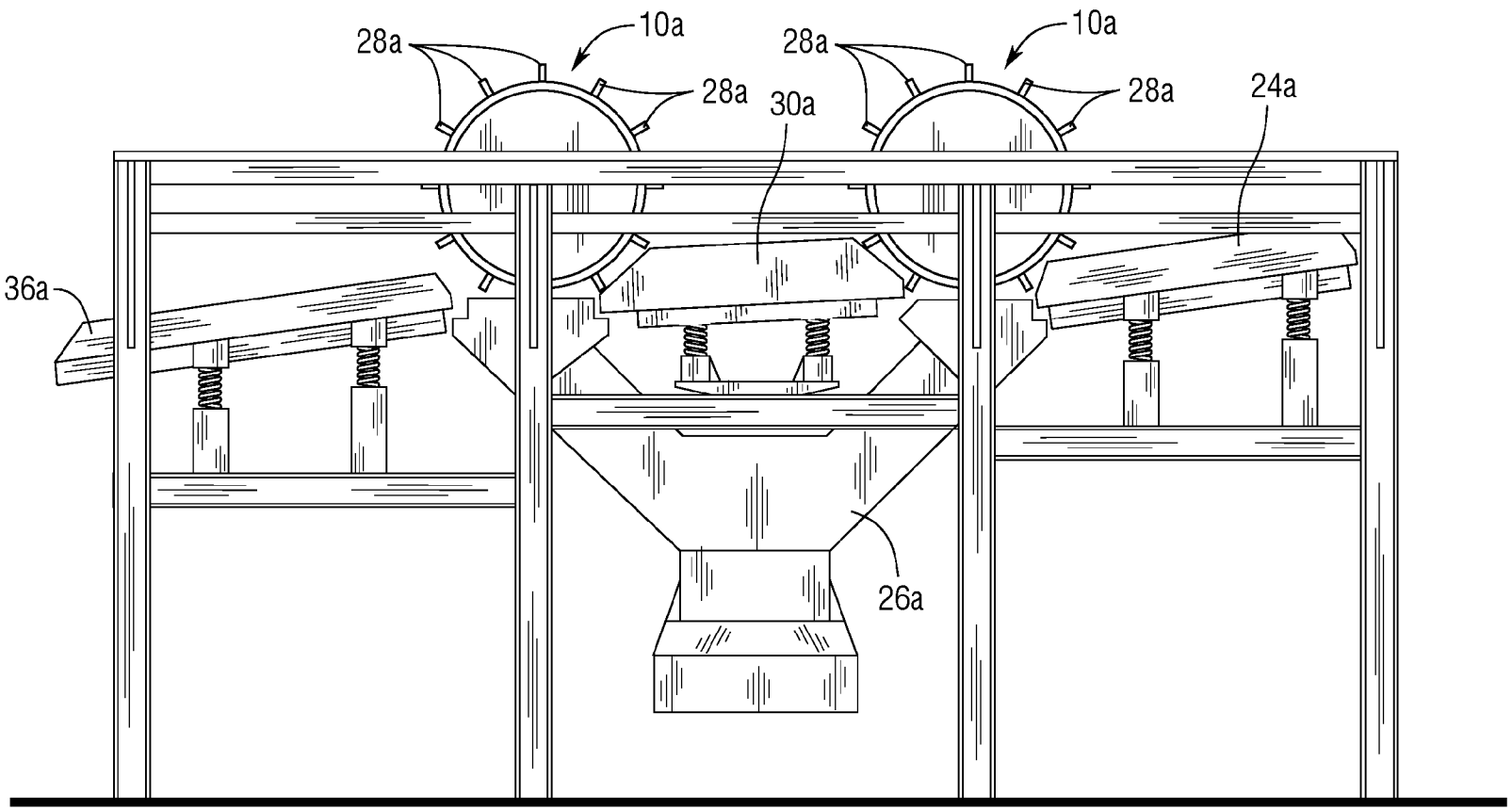
FIG. 8 depicts an embodiment of drum separator in which two drum separators are used in series.

FIG. 8 shows an embodiment of drum separator 10*a* in which two drum separators 10*a* are placed in series. In this instance, the transfer systems used to move the material stream to and from each drum separator 10*a* are a series of vibrating chutes 24*a*, 30*a*, 36*a*. The non-ferrous material from the material stream that is not attracted to the drum separators 10*a* drop into a chute 26*a* for disposal or further processing. In this embodiment, the first drum separator 10*a* does an initial screening of the material stream for ferrous materials which may inadvertently catch non-ferrous material. The second drum separator 10*a* is used to clean up the material stream further for a better sorted product.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

What is claimed is:

1. A permanent magnet drum separator for removal of a ferrous fraction from a material stream comprising:

a rotatable outer shell having tubular shape with a circular cross section;

a pickup magnet that is a rare earth permanent magnet positioned on a hinge plate within said rotatable outer shell;

a carry magnet housed within said rotatable outer shell, said carry magnet positioned at a fixed location within said rotatable outer shell near the inside circumference of said rotatable outer shell; and said hinge plate having a first end attached to hinge and a second end attached to a movable element, said hinge positioned at a fixed location within said rotatable outer shell near the inside circumference of said rotatable outer shell, said movable element able to move said pickup magnet about said hinge to vary the distance between said pickup magnet and the inside circumference of said rotatable outer shell by moving said pickup magnet closer to the center of said rotatable outer shell.

2. The permanent magnet drum separator of claim 1 further comprising said pickup magnet having an energy product of between 35 MGOe and 42 MGOe.

3. The permanent magnet drum separator of claim 1 in which said pickup magnet further comprises more than one array of pickup magnets in series.

4. The permanent magnet drum separator of claim 1 in which said movable element is hydraulically or electrically actuated cylinders.

5. A permanent magnet drum separator for removal of a ferrous fraction from a material stream comprising:

a rotatable outer shell having tubular shape with a circular cross section;

a pickup magnet that is a rare earth permanent magnet positioned within said rotatable outer shell;

a carry magnet housed within said rotatable outer shell, said carry magnet positioned at a fixed location within said rotatable outer shell near the inside circumference of said rotatable outer shell; and means for moving said pickup magnet within said rotatable outer shell to vary the distance between said pickup magnet and the inside circumference of said rotatable outer shell.

6. The permanent magnet drum separator according to claim 5 further comprising said pickup magnet having an energy product of between 35 MGOe and 42 MGOe.

7. The permanent magnet drum separator of claim 5 in which said pickup magnet further comprises more than one array of pickup magnets in series.

* * * * *